US007326849B2

(12) United States Patent
Adams et al.

(10) Patent No.: US 7,326,849 B2
(45) Date of Patent: Feb. 5, 2008

(54) FOOT-OPERATED DOCKING STATION FOR ELECTRONIC MODULES USED WITH MUSICAL INSTRUMENTS

(75) Inventors: Charles C. Adams, Gilbert, AZ (US); Dale V. Curtis, Scottsdale, AZ (US); Jeremy A. Brieske, Denver, CO (US); Lawrence E. Lorenzen, Phoenix, AZ (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 0 days.

(21) Appl. No.: 11/400,472

(22) Filed: Apr. 6, 2006

(65) Prior Publication Data

US 2007/0245886 A1 Oct. 25, 2007

(51) Int. Cl.
*G10H 1/32* (2006.01)

(52) U.S. Cl. ..... 84/746; 84/743

(58) Field of Classification Search ..... 84/721, 84/746, 454, DIG. 18, 743
See application file for complete search history.

(56) References Cited

U.S. PATENT DOCUMENTS 4,509,190 A * 4/1985 Spector ..... 381/61
4,672,671 A * 6/1987 Kennedy ..... 381/61
5,877,443 A * 3/1999 Arends et al. ..... 84/454
6,689,947 B2 * 2/2004 Ludwig ..... 84/721
2002/0065568 A1 * 5/2002 Silfvast et al. ..... 700/94
2004/0069121 A1 * 4/2004 Georges ..... 84/609
2005/0126372 A1 * 6/2005 Ludwig ..... 84/645
2006/0064186 A1 * 3/2006 Ryle et al. ..... 700/94

* cited by examiner

*Primary Examiner*—Lincoln Donovan
*Assistant Examiner*—Andrew Millikin
(74) *Attorney, Agent, or Firm*—Robert D. Atkins; Quarles & Brady LLP

(57) ABSTRACT

A modular docking station receives a variety of electronic modules, such as a tuner, effects processor, signal conditioner, signal distributor, and signal converter, for use with a musical instrument, such as a guitar. A base unit has a flat bottom portion and an angled top portion. A plurality of pushbutton switches are disposed in the angled top portion of the base unit. The electronic module is controlled by the pushbutton switches through the base unit. A plurality of electronic modules, each with a different electrical function, are interchangeable into the receptacle of the base unit. One electronic module is selected for inserting into the base unit to make mechanical and electrical contact. Each electronic module includes a display area and a plurality of indicators for the various electrical functions of the electronic module. The base unit has a connector for connecting to the musical instrument.

13 Claims, 5 Drawing Sheets

FOOT-OPERATED DOCKING STATION FOR ELECTRONIC MODULES USED WITH MUSICAL INSTRUMENTS

FIELD OF THE INVENTION

The present invention relates in general to electronic modules for use with musical instruments and, more particularly, to a foot-operated docking station for receiving electronic modules used with musical instruments.

BACKGROUND OF THE INVENTION

Musical instruments have always been very popular in society—providing entertainment, social interaction, self-expression, and a business and source of livelihood for many people. String instruments are especially popular because of their active playability, tonal properties, and portability. String instruments are fun and yet challenging to play, have great sound qualities, and are easy to move about from one location to another.

Guitars are one type of string musical instrument. The musical artist, or user, plays the guitar by using his or her fingers, or a guitar pick, to displace one or more of the tightly-strung strings from a neutral position and then releasing it, causing the string to vibrate as it returns to its neutral position. The guitar pick offers certain advantages over the fingers in terms of sharpness of the string vibration and clarity of the note played.

A guitar has a certain number of strings, e.g., five or six strings, which are tightly strung along a fret board between a bridge and neck assembly. One end of each guitar string is typically firmly attached or held to the bridge. The other end of each strings is respectively attached to geared machine heads on the head stock assembly, which are used to tighten and loosen the tension of each string.

The string tension is very important to the performance of the guitar. Each string of the guitar is designed to resonate with a specific frequency. Given the resonant frequency of each string, the guitar player presses his or her fingertips of the off-hand on different locations of the strings on the fret board to produce different musical notes. If the string tension is not properly adjusted, then the base resonant frequency of the string is off and the notes played will not sound right. The guitar is then considered out-of-tune and will not play as designed or intended.

A variety of tuning techniques have been devised over the years to set the proper string tension on each guitar string. In most if not all cases, the user must displace the strings with his or her fingers and then monitor an external tuning device to make adjustments to the string tension. Since the user's hands are occupied with the guitar, it is difficult to simultaneously work with the tuner. The user must go back and forth between the guitar and the tuner to adjust the string tension.

A similar problem exists for other electronic modules used with guitars. For example, if the guitar player is using an effects processor to enhance and adjust the acoustic qualities for the instrument, then he or she must work back and forth between playing the instrument and making adjustments to the effects processor. The same can be said for other electronic modules, such as signal conditioning, signal distribution, and signal conversion, which are used to enhance and manipulate the audio signal from the guitar. Simultaneously handling the guitar while trying to adjust electronic modules used with the instrument is cumbersome and inefficient.

At the same time, each type of electronic module used with the guitar must be connected to the instrument with cables. The time and effort it takes to disconnect one electronic module, e.g. a tuner, and connect additional electronic modules, e.g. effects processors, is inconvenient and burdensome.

A need exists to more readily access and utilize electronic modules which enhance the performance of musical instruments.

BRIEF DESCRIPTION OF THE DRAWINGS

In one embodiment, the present invention is a modular docking station for use with a musical instrument, comprising a base unit having a flat bottom portion and an angled top portion. A plurality of pushbutton switches are disposed in the angled top portion of the base unit. An electronic module is inserted into a receptacle of the base unit to make mechanical and electrical contact with the base unit to adjust the tonal properties of the musical instrument.

In another embodiment, the present invention is a modular docking system for use with a guitar, comprising a base unit having a plurality of pushbutton switches disposed in a top portion of the base unit. A plurality of electronic modules are each insertable into a receptacle of the base unit to make mechanical and electrical contact with the base unit. Each electronic module has a display area for displaying a functional state of the electronic module.

In another embodiment, the present invention is a modular docking system for use with a musical instrument, comprising a docking station having a pushbutton switch and a receptacle. An electronic module enhances the audio signal from the musical instrument. The electronic module is adapted for inserting into the receptacle of the docking station to make mechanical and electrical contact with the docking station to adjust the tonal properties of the musical instrument.

In another embodiment, the present invention is a method of using a plurality of electronic modules with a musical instrument, comprising the steps of providing a docking station with a plurality of pushbutton switches disposed in a top portion of the docking station, and inserting one of a plurality of electronic modules into a receptacle of the docking station to make mechanical and electrical contact with the docking station to adjust the tonal properties of the musical instrument.

In another embodiment, the present invention is a modular docking system for use with a musical instrument comprising a docking station having a pushbutton switch and an external connector. An electronic module enhances audio signal from the musical instrument. The electronic module is adapted for inserting into a receptacle of the docking station to make mechanical and electrical contact with the docking station to adjust the tonal properties of the musical instrument. The electronic module further includes an external connector functionally equivalent to the external connector of the docking station to allow the electronic module to operate separate from the docking station.

BRIEF DESCRIPTION OF THE DRAWINGS

Figure 1:
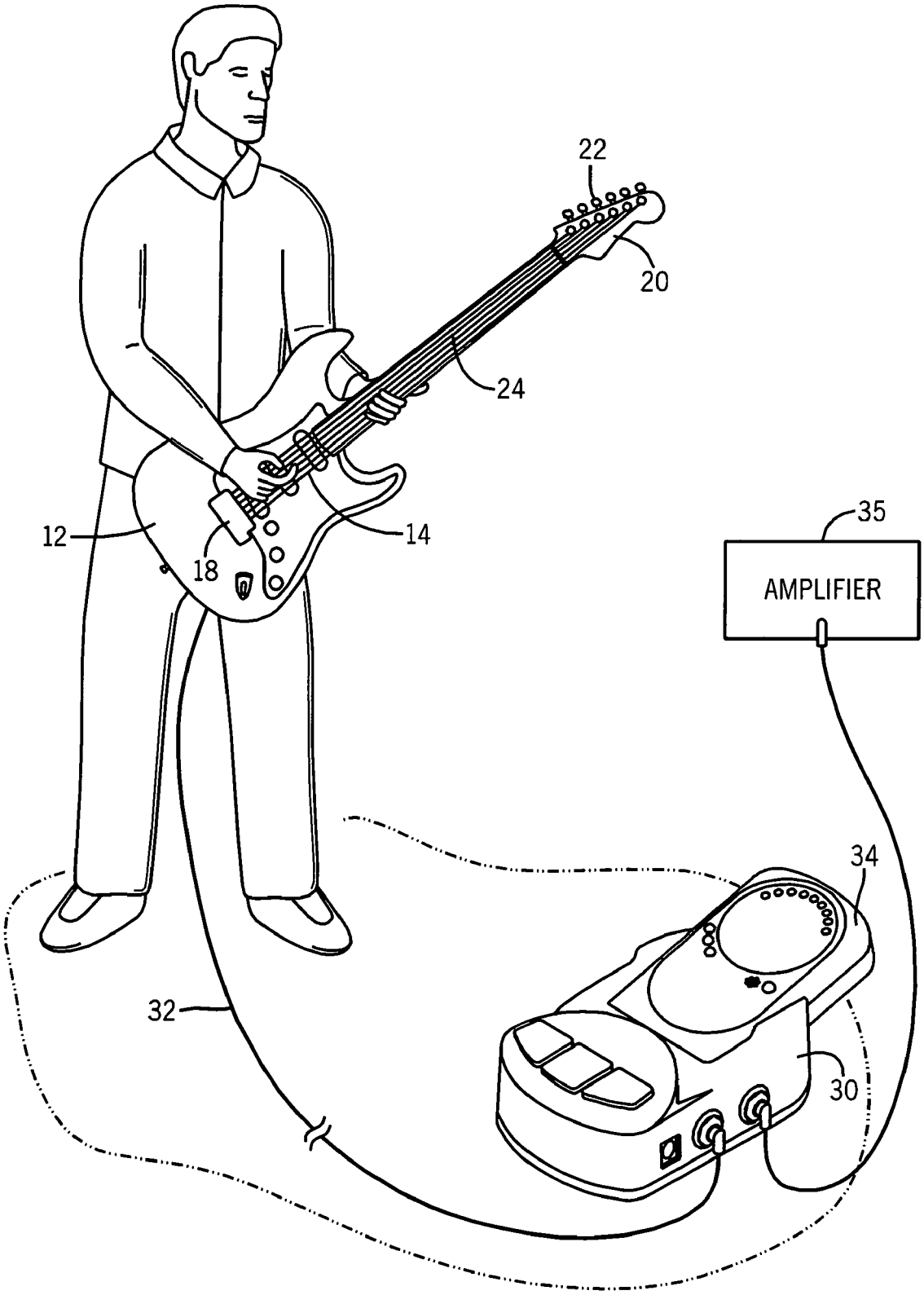
Figure 2A:
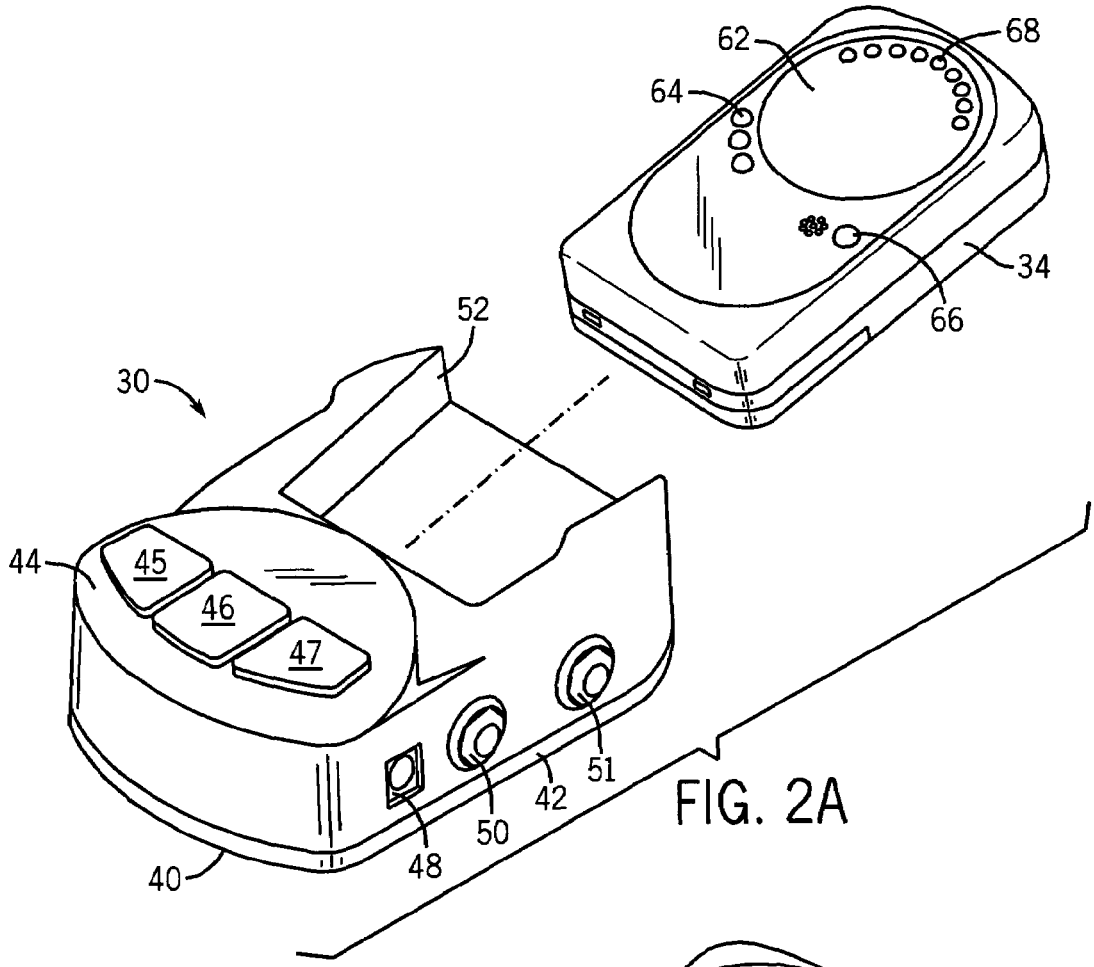
Figure 2B:
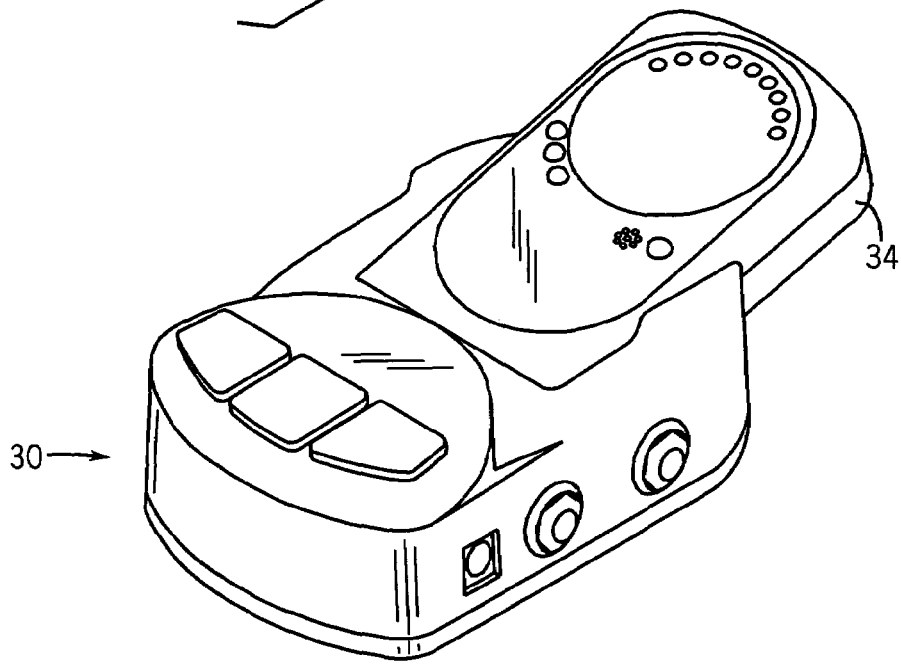
Figure 3:
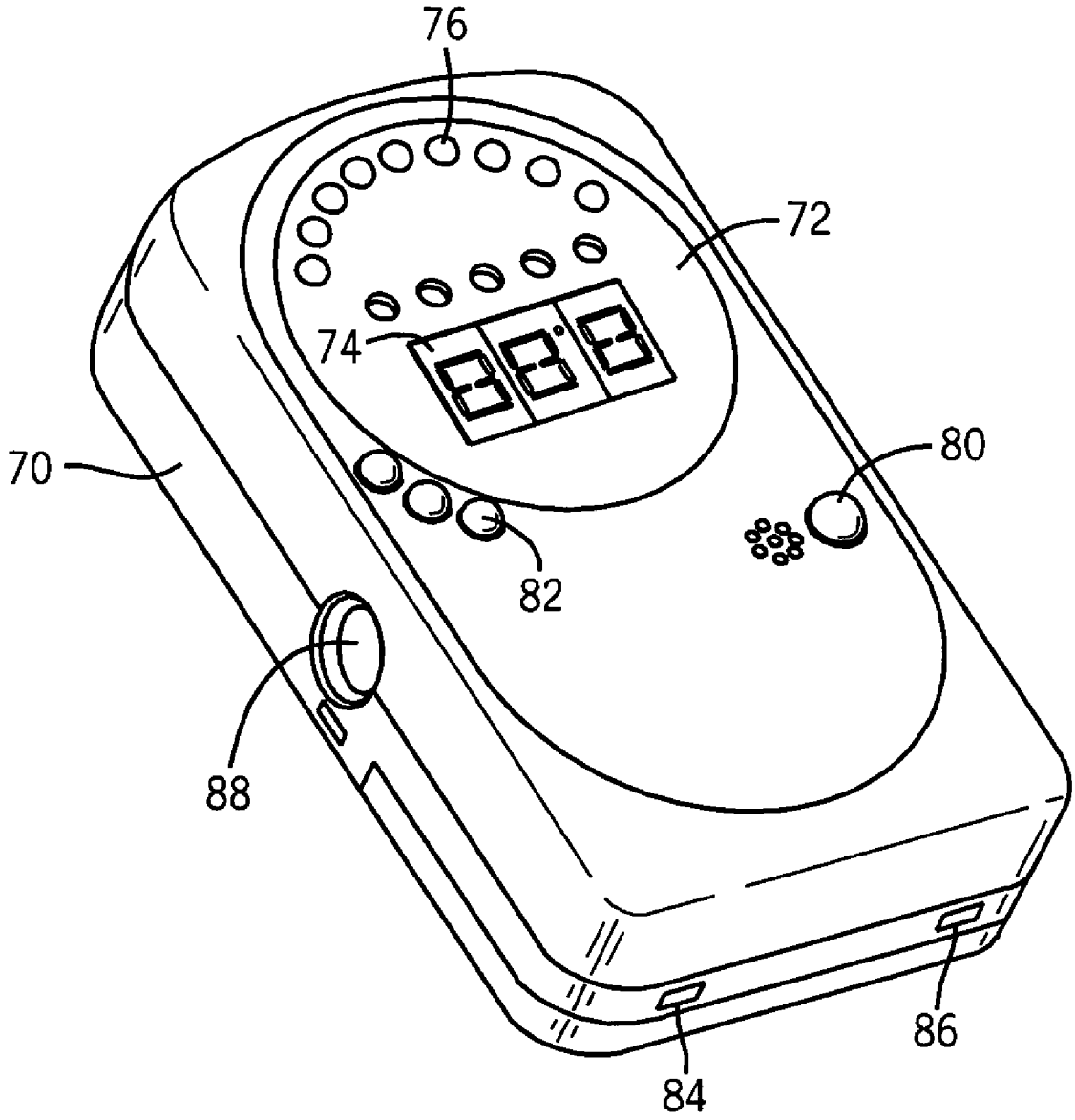
Figure 4:
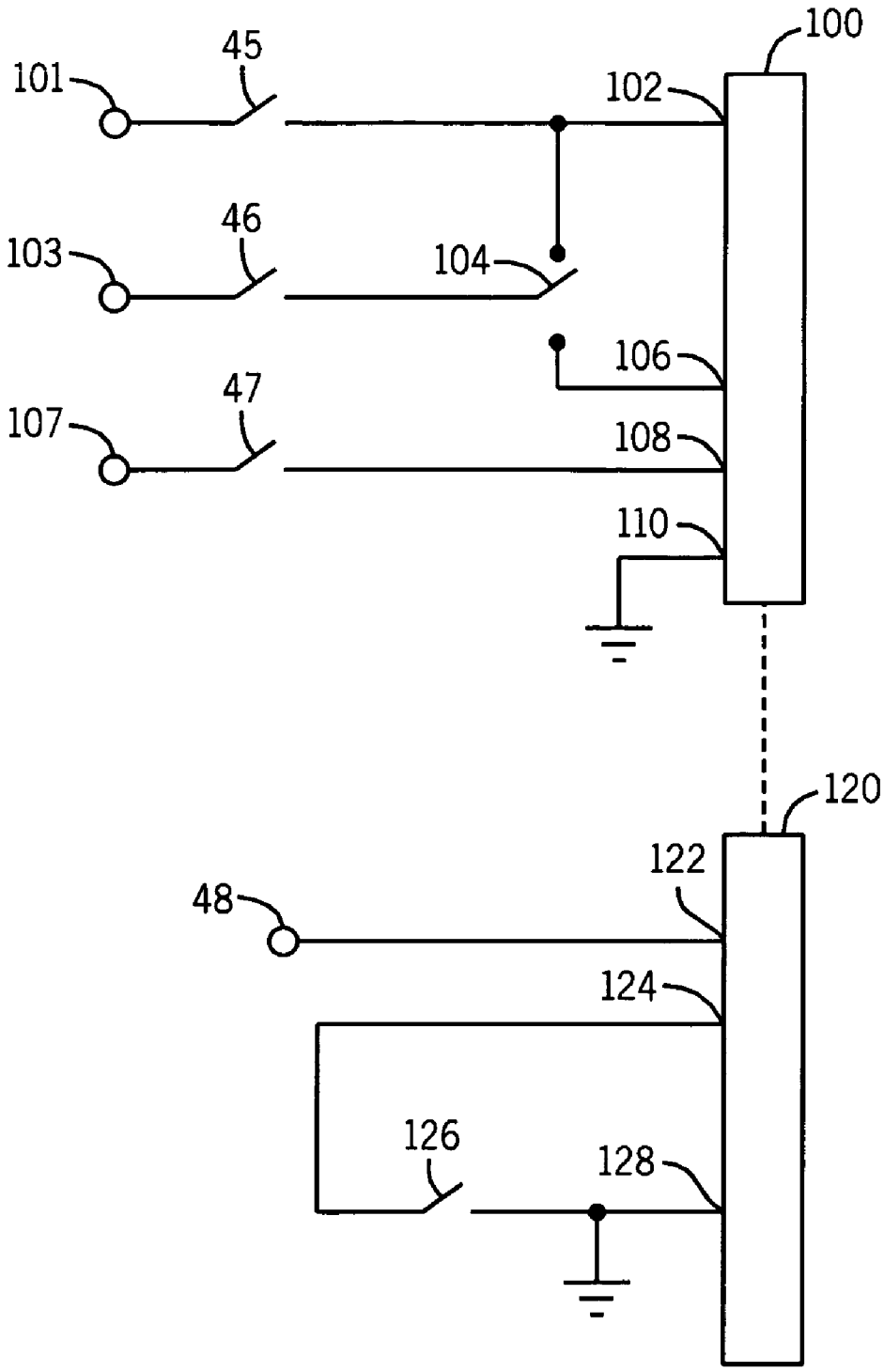
Figure 5:
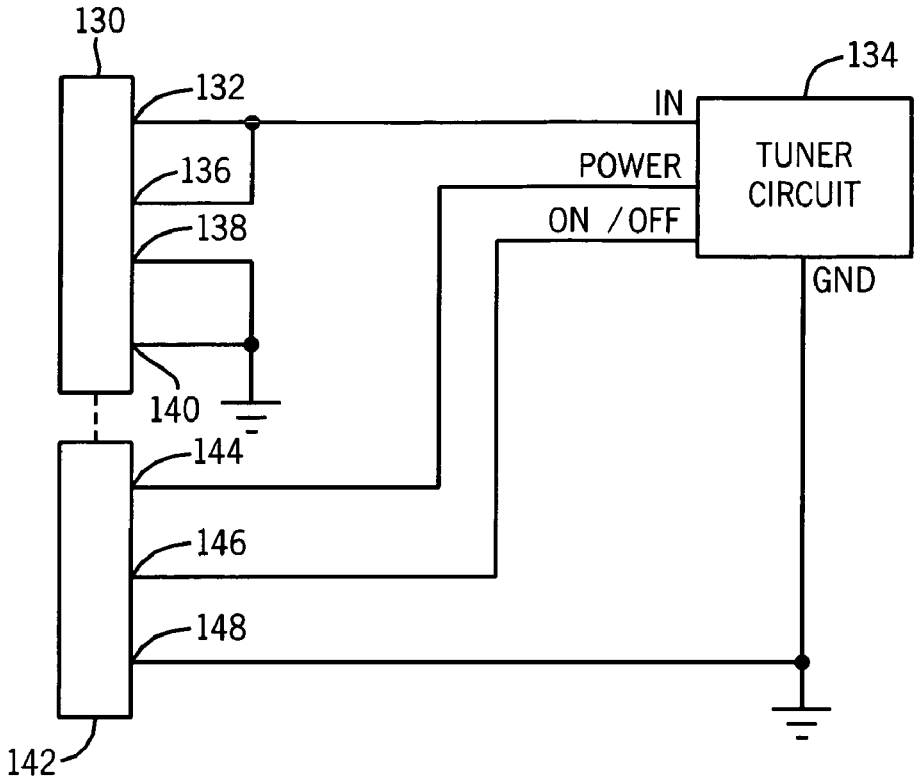

FIG. 1 illustrates a guitar connected to a modular foot-operated docking system;

FIGS. 2A and 2B illustrate the docking station receiving an electronic module;

FIG. 3 illustrates an electronic tuner module;

FIG. 4 is a wiring diagram of the docking station;

FIG. 5 is a wiring diagram of the electronic tuner module; and

Figure 6:
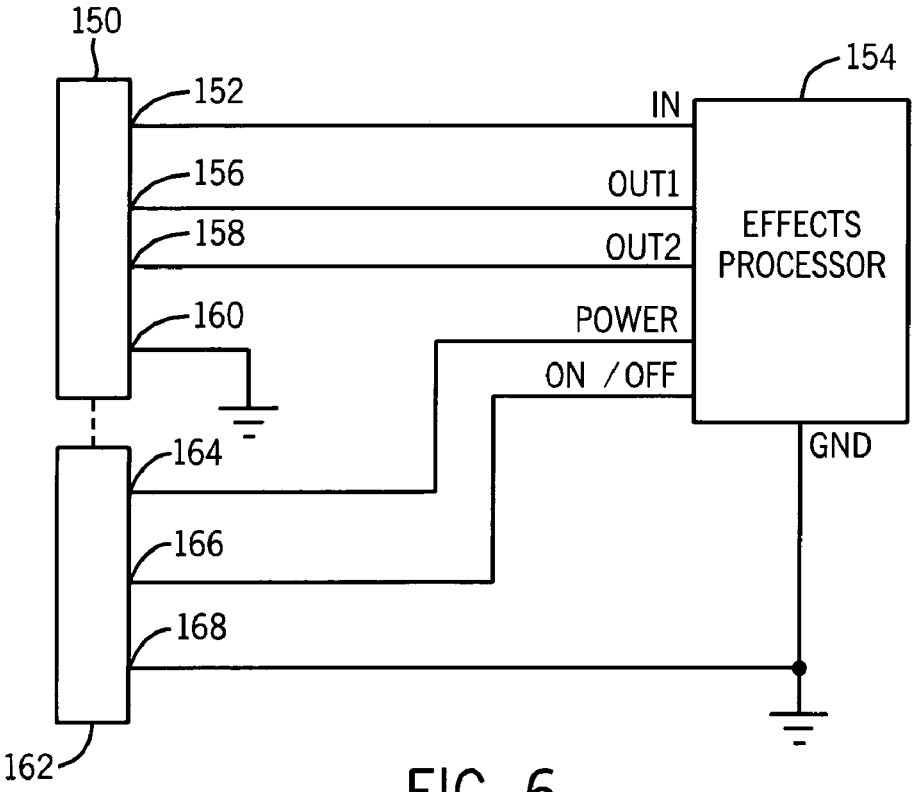

FIG. 6 is a wiring diagram of the electronic effects processor module.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Referring to FIG. 1, a musical instrument is shown as guitar 12. There are many types and configurations of guitars including electric, electric bass, and acoustic styles. Other types of musical string instruments include the mandolin, viola, and violin. Each type of musical instrument has a number of strings running across the frame of the instrument. The musical artist plays the instrument by displacing one or more of the tightly-strung strings from a neutral position and then releasing it, causing the string to vibrate as it returns to its neutral position. The string vibration emits different sounds depending on the type of instrument and skill of the musician.

Other types of musical instruments that require periodic tuning include keyboards, percussion, horns, and the like. Each of these instruments emits audible sound and requires adjustment from time to time for optimal performance.

In the case of guitar 12, a plurality of strings 14 are routed from bridge 18 across the body or soundboard to head stock assembly 20. Guitar 12 may have five or six strings which are tightly strung between bridge 18 and head stock assembly 20. One end of each guitar string 14 is firmly attached or held to bridge 18. The other ends of strings 14 are attached to respective machine heads 22 on head stock assembly 20. Machine heads 22 are geared and can be rotated or turned to increase or decrease the tension on strings 14.

The string tension is very important to the performance of the guitar. Guitar 12 is designed such that each string 14 resonates at a specific frequency. Given the resonant frequency of each string, the guitar player presses his or her fingertips of the off-hand on different locations of strings 14 on fret board 24 to produce different musical notes. If the string tension is not properly adjusted, then the base resonant frequency of the string is off and the note played will not sound right. The guitar is then considered out-of-tune and will not play as intended or designed.

For a given type of string, the string tension determines, to a significant degree, the resonant frequency of that string. Machine heads 22 are a primary string tension adjustment available to the artist or technician. Turning machine head 22 in one direction, e.g., clockwise, increases the string tension; turning machine head 22 in the other direction, e.g., counter-clockwise, reduces the string tension. The correct string tension is a fundamental precursor and requirement to maintaining guitar 12 in its properly tuned state or condition.

Guitar strings 14 can lose their correct tension in normal play and even more readily become out-of-tune when the instrument is played in an aggressive manner. The artist may find guitar 12 loses optimal string tension over the course of a playing session or performance and even between and during individual musical pieces. The artist typically does not have the time or opportunity to have the guitar professionally re-tuned in such settings. The artist may make use of portable tuners, or simply make best efforts to re-adjust the string tension, often by ear or feel alone. The artist turns machine heads 22 until the instrument sounds or feels as good as it's going to get at the time, and awaits the next time that the instrument is in the repair shop or technician's bench for a thorough and proper re-tune.

Portable tuners are generally available as an electronic module with an input jack for electrically connecting to the musical instrument and thereby receiving and measuring the frequency of the audio signals. Such tuners can also have a microphone input for receiving and measuring the frequency of the audio signals from the instrument.

There are other electronic modules which are used to enhance or manipulate the sound from the musical instrument. In one example, an effects processor is known to introduce distortion into the audio signal. The effects processor can also add chorus, reverb, and delay effects into the audio signal. Other examples of electronic module 34 include signal conditioner (filtering), signal distribution, and signal conversion (analog to digital or digital to analog).

These electronic modules often require human control to adjust the various functions and features available with the module. Unfortunately, the player's hands are typically occupied with playing the instrument, making it difficult to simultaneously work with the electronic modules. The present invention allows the user to keep his or her hands on the guitar while adjusting the electronic module with the foot. The present invention further allows different electronic modules to be readily interchanged in a docking station for the desired audio control.

FIG. 1 illustrates guitar 12 connected to docking station or base unit 30. The audio signals from guitar 12 are routed to docking station 30 by way of cable 32. Docking station 30 is designed to rest on the floor and be operated by the artist's foot. Docking station 30 receives an electronic module 34 to provide electrical functions for guitar 12. Several different electronic modules are supported by docking station 30. The user selects the electronic module to be inserted into docking station 30 depending on the desired effect. The electronic module 34 easily slips into docking station 30 and makes a mechanical and electrical connection. The combination of docking station 30 and electronic module 34 makes up a modular docking system. The artist depresses one or more pushbuttons on the top surface of docking station 30 to activate features within electronic module 34. The artist can visually monitor a display area 36, e.g. via liquid crystal display (LCD) or light emitting diodes (LED), on the electronic module. Docking station 30 is further connected to amplifier 35, which receives the effects of the electronic module 34.

Further detail of docking station 30 is shown in FIG. 2A. Docking station 30 has a flat bottom portion 40 with non-slip surface 42 such as rubber or similar synthetic material. The non-slip surface 42 may have ridges or grooves for additional shear gripping strength. Docking station 30 has a beveled portion 44 with three pushbutton electrical switches 45, 46, and 47. Beveled portion 44 is angled to conveniently fit under the artist's shoe or foot, i.e. either the toe or ball portion of the shoe, with the heel resting on the ground. Pushbutton switches 45-47 are foot-operated and can be individually pressed or activated by applying pressure with the foot. The artist can separately or simultaneously press the left pushbutton, the middle pushbutton, and/or the right pushbutton. Connector 48 is a DC power jack. Connector 50 is an 0.25-inch jack for connecting cable 32 to guitar 12 to receive the audio signal from the instrument. Docking station 30 may include additional connectors 51 for various input and output functions depending on the electronic module. Each connector 50 may be an input or output and have different functions depending on the electronic module selected.

Docking station 30 further includes a slot or receptacle 52 for receiving a plug-in electronic module 34. Electronic module 34 slides into receptacle 52 and makes mechanical and electrical contact with docking station 30. The electrical signal or function selected by pressing one of pushbuttons 45-47 is transmitted to electronic module 34. Electronic module 34 generally has a display area 62 and indicator light emitting diodes (LEDs) 64 and 66. LED 64 may indicate one or more functions associated with electronic module 34. LED 66 is an electric power indicator. Display area 62 may have further indicator lights 68 for showing dynamic ranges and scaling, depending on the electronic module in use.

FIG. 2B illustrates electronic module 34 inserted into receptacle 52 of docking station 30. Electronic module 34 becomes an integral part of docking station 30 by nature of the mechanical and electrical connection.

The electronic module 34 is interchangeable in docking station 30 and can take several embodiments. In one embodiment, electronic module 34 is an effects processor which introduces distortion into the audio signal. The effects processor can also add chorus, reverb, and delay effects into the audio signal. Display 62 shows the present state of the effects processor. The artist can control the audio output of guitar 12 by way of foot-operated pushbutton switches 45-47.

In another embodiment, electronic module 34 is a tuner for adjusting the string tension of guitar 12. By pressing pushbuttons 45-47, the artist can control the electronic tuner module. The electronic tuner module can be used to tune both acoustic and electric guitars. FIG. 3 illustrates electronic tuner module 70. The tuning module has a tuning range from low bass G0 through high treble C8. Tuner module 70 has an auto-calibration feature with a calibration range from 435 to 445 Hz and a detection accuracy of +/−1%. The unit can also be battery powered. Display area 72 has a numeric readout 74 which provides the frequency in Hertz of the guitar string.

During the tuning process, when guitar string 14 is played, the audio signal from the string vibration is transmitted through cable 32 and docking station 30 to electronic module 70. The frequency of the string vibration is displayed in numeric readout 74. A first string is intended to produce an E note and has a resonant frequency of 82.4 Hz; a second string is intended to produce an A note and has a resonant frequency of 110 Hz; a third string is intended to produce a D note and has a resonant frequency of 146.83 Hz; a fourth string is intended to produce a G note and has a resonant frequency of 195.99 Hz; a fifth string is intended to produce a B note and has a resonant frequency of 246.94 Hz; a sixth string is intended to produce an E note and has a resonant frequency of 329.62 Hz. The user can adjust machine heads 22 to change the string tension until the properly tuned frequency is displayed.

Consider one exemplary process of tuning guitar 12. The user kicks one of the foot-operated pushbuttons to select the tuning frequency for the first guitar string. The user plays the first guitar string. The frequency of the first string appears on numeric readout 74. The user adjusts the machine head 22 associated with the first guitar string. The user plays the first guitar string again. The process repeats until the numeric readout for the first guitar string is 82.4 Hz, which is the desired tuned frequency for the first string.

The tuning process continues to the second guitar string. The user kicks the foot-operated pushbutton again to select the tuning frequency for the second guitar string. The user plays the second guitar string. The frequency of the second string appears on numeric readout 74. The user adjusts the machine head 22 associated with the second guitar string. The user plays the second guitar string again. The process repeats until the numeric readout for the second guitar string is 110 Hz, which is the desired tuned frequency for the second string. The same tuning process is repeated for the third, fourth, fifth, and sixth guitar strings.

Display area 72 may further include indicator 76 for showing dynamic ranges and scaling. LED 80 is an electric power indicator. LEDs 82 indicate one or more functions associated with electronic tuner module 70. Connectors 84 and 86 mate with corresponding terminals in receptacle 52 of docking station 30.

Other electronic modules available for use with docking station 30 to adjust and control the audio signal from the guitar include signal conditioning (filtering), signal distribution, and signal conversion (analog to digital or digital to analog). Each electronic module is inserted into the docking station and controlled by foot-operated pushbutton switches 45-47.

In general, each type of electronic module, which can be inserted into docking station 30, can also be use independently of the docking station. For example, electronic tuner module 70 further includes connector 88 for connecting directly to cable 32. The tuner may have a microphone input for receiving and measuring the frequency of the audio signals from the guitar. In this case, the tuner module can operate without docking station 30. The connector 88 on the electronic tuner module 70 performs the same electrical function as connector xxx on the docking station. Thus, the electronic module can be used with the docking station or separate and apart from the docking station as may be convenient and useful for the artist. In a similar manner, an electronic module which provides effects processing can also be used with the docking station or separate and apart from the docking station by making appropriate connections.

A wiring diagram for docking station 30 is shown in FIG. 4. When closed, pushbutton switch 45 connects an I/O terminal 101 to terminal 102 of connector block 100. In one embodiment, connector 50 of docking station 30 is connected to I/O terminal 101. When closed, pushbutton switch 46 connects an I/O terminal 103 ground terminal to a first terminal of double-pole, double-throw switch 104. A second terminal of switch 104 connects either to terminal 102 or terminal 106 of connector block 100. When closed, pushbutton switch 47 connects an I/O terminal 107 to terminal 108 of connector block 100. Connector 48 of docking station 30 is electrically connected to terminal 122 of connector block 120. Terminal 124 is connected to a first terminal of switch 126. A second terminal of switch 126 is connected to terminal 128 of connector block 120.

A wiring diagram for electronic tuner module 70 is shown in FIG. 5. Connector block 130 mates with connector block 100. Terminal 132 of connector block 130 connects to the IN terminal of tuner circuit 134. Likewise, terminal 136 connects to the IN terminal of tuner circuit 134. Terminals 138 and 140 connect to a ground terminal. Connector block 142 mates with connector block 120. Terminal 144 of connector block 142 connects to a POWER terminal of tuner circuit

134. Terminal 146 connects to a ON/OFF terminal of tuner circuit 134. Terminal 148 connects to a ground terminal of tuner circuit 134.

A wiring diagram for the electronic effects processor module is shown in FIG. 6. Connector block 150 mates with connector block 100. Terminal 152 of connector block 150 connects to the IN terminal of effects processor 154. Terminal 156 connects to the OUT1 terminal of effects processor 154. Terminal 158 connects to the OUT2 terminal of effects processor 154. Terminal 156 connects to a ground terminal. Connector block 162 mates with connector block 120. Terminal 164 of connector block 162 connects to a POWER input terminal of effects processor 154. Terminal 166 connects to a ON/OFF terminal of effects processor 154. Terminal 168 connects to a ground terminal of effects processor 154.

While one or more embodiments of the present invention have been illustrated in detail, the skilled artisan will appreciate that modifications and adaptations to those embodiments may be made without departing from the scope of the present invention as set forth in the following claims.

What is claimed is:

1. A modular docking station for use with a musical instrument, comprising:

a foot-operated base unit having a flat bottom portion and an angled top portion, the flat bottom portion having a non-slip surface with ridges for shear gripping strength;

a plurality of pushbutton switches disposed in the angled top portion of the base unit, the plurality of pushbutton switches positioned to permit separate and simultaneous activation by foot operation; and a plurality of electronic modules each capable of insertion into a receptacle of the base unit to make mechanical and electrical contact with the base unit to adjust the tonal properties of the musical instrument, the electronic modules each being controlled solely by the plurality of pushbutton switches, each electronic module including an electronic display for displaying numeric readouts, each electronic module further including a plurality of light emitting diodes for indicating functional state of the electronic module as determined by the electronic module in use, wherein the electronic modules are configurable for use with the musical instrument without the foot-operated base unit.

2. The modular docking station of claim 1, wherein the electronic module is a tuner.

3. The modular docking station of claim 1, wherein the electronic module is selected from the group consisting of an effects processor, signal conditioner, signal distributor, and signal converter.

4. The modular docking station of claim 1, wherein the base unit includes a connector for connecting to the musical instrument.

5. The modular docking station of claim 1, wherein the musical instrument is a guitar.

6. A modular docking system for use with a guitar, comprising:

a foot-operated base unit having a plurality of pushbutton switches disposed in a top portion of the base unit; and a plurality of electronic modules, each insertable into a receptacle of the base unit to make mechanical and electrical contact with the base unit, the electronic modules each being controlled solely by the plurality of pushbutton switches, each electronic module having an electronic display area for displaying a numeric readout, each electronic module further including a plurality of light emitting diodes for indicating functional state of the electronic module as determined by the electronic module in use, wherein the electronic modules are configurable for use with the musical instrument without the foot-operated base unit.

7. The modular docking system of claim 6, wherein one of the plurality of electronic modules is a tuner.

8. The modular docking system of claim 6, wherein a plurality of electronic modules are selected from the group consisting of an effects processor, signal conditioner, signal distributor, and signal converter.

9. The modular docking system of claim 6, wherein the base unit includes a connector for connecting to the guitar.

10. The modular docking system of claim 6, wherein the electronic module is controlled by the pushbutton switch through the base unit.

11. A method of using a plurality of electronic modules with a musical instrument, comprising:

providing a foot-operated docking station with a plurality of pushbutton switches disposed in a top portion of the docking station; and inserting one of a plurality of electronic modules into a receptacle of the docking station to make mechanical and electrical contact with the docking station to adjust the tonal properties of the musical instrument, the electronic module being controlled solely by the plurality of pushbutton switches, the electronic module including an electronic display for displaying numeric readouts, the electronic module further including a plurality of light emitting diodes for indicating functional state of the electronic module as determined by the electronic module in use, wherein the electronic module is configurable for use with the musical instrument without the foot-operated base unit.

12. The method of claim 11, wherein one of the plurality of electronic modules is a tuner.

13. The method of claim 11, wherein the plurality of electronic modules are selected from the group consisting of an effects processor, signal conditioner, signal distributor, and signal converter.

* * * * *